United States Patent [19]

Sundermeier

[11] Patent Number: 4,712,271

[45] Date of Patent: Dec. 15, 1987

[54] MOUNTING PLATE FOR A FURNITURE HINGE WHICH IS ADJUSTABLE IN HEIGHT

[75] Inventor: Günter Sundermeier, Bünde, Fed. Rep. of Germany

[73] Assignee: Paul Hettich GmbH & Co., Kirchkengern, Fed. Rep. of Germany

[21] Appl. No.: 844,354

[22] PCT Filed: May 24, 1985

[86] PCT No.: PCT/DE85/00178

§ 371 Date: Jan. 3, 1986

§ 102(e) Date: Jan. 3, 1986

[87] PCT Pub. No.: WO86/00367

PCT Pub. Date: Jan. 16, 1986

[30] Foreign Application Priority Data

Jun. 23, 1984 [DE] Fed. Rep. of Germany ..... 8418939

[51] Int. Cl.[4] ..... E05D 7/04

[52] U.S. Cl. ..... 16/238; 16/DIG. 39

[58] Field of Search ..... 16/238, 240, 241, 245, 16/246, 382, DIG. 43, DIG. 39

[56] References Cited

FOREIGN PATENT DOCUMENTS

| | | | |
|---|---|---|---|
| 2542462 | 3/1977 | Fed. Rep. of Germany | 16/238 |
| 2657628 | 6/1978 | Fed. Rep. of Germany | 16/245 |
| 2655749 | 6/1978 | Fed. Rep. of Germany | 16/238 |
| 1782943 | 8/1978 | Fed. Rep. of Germany | 16/DIG. 43 |
| 353131 | 10/1979 | Fed. Rep. of Germany . | |
| 3006428 | 8/1981 | Fed. Rep. of Germany . | |
| 2307107 | 11/1976 | France . | |

*Primary Examiner*—Nicholas P. Godici
*Assistant Examiner*—Karen Skillman
*Attorney, Agent, or Firm*—Michael J. Striker

[57] ABSTRACT

The mounting plate which is mountable on a furniture body and on which the hinge arm of a furniture hinge is mounted is comprised of two parts, namely an upper part and a base plate which is mountable on the furniture body. The base plate engages in the center area in a recess (25) extending transversely to the longitudinal axis of the upper part and is displaceably and lockably mounted therein. The base plate is provided with a threaded bore into which the threaded shaft of a mounting screw is screwed in so as to lock the upper part with respect to the base plate. The threaded shaft is guided through a slotted hole in the upper part, so that the upper part is transversely adjustable with respect to its longitudinal axis when the screw is released.

6 Claims, 3 Drawing Figures

MOUNTING PLATE FOR A FURNITURE HINGE WHICH IS ADJUSTABLE IN HEIGHT

BACKGROUND OF THE INVENTION

The invention relates to a mounting plate for a furniture hinge which is adjustable in height and a hinge arm of which is mounted on the mounting plate.

Furniture hinges are known, whereby the doors are rotatably connected with a furniture body and which are provided with a side, lowering or heighwise adjustment. The vertical adjustment is performed parallel to the rotating axis and may be performed by a set screw, for example, which is mounted in a thread bore of the mounting plate and which supports with their end ranges, which are provided with slots for introducing an operational tool, on the lateral plates of the hinge arm.

SUMMARY OF THE INVENTION

It is an object of the invention to provide a mounting plate of the aforementioned type in such a manner that with simple constructive means a height adjustment of the part of the mounting plate is made possible, which is mounted on the hinge arm.

This object of the invention is solved in that the mounting plate consists of an upper part and a base plate which is mounted on the furniture body and that the base plate engages in the center area into a recess of the upper part which extends transversely to the longitudinal axis of the upper part and is displaceably and lockably mounted therein.

In an advantageous embodiment of the invention the upper part of the mounting plate is provided with a U-shaped cross section and the upper part and the base plate are shaped as stamped sheet metal parts. The stationary guiding of the upper part with respect to the base plate is obtained in that the side plates of the upper part are provided with recesses into which the base plate engages.

Further features of the invention are stated in the subclaims and the following description of exemplified embodiments illustrated in the drawings.

DETAILED DESCRIPTION OF THE PREFERRED EMBODIMENTS

Figure 1:
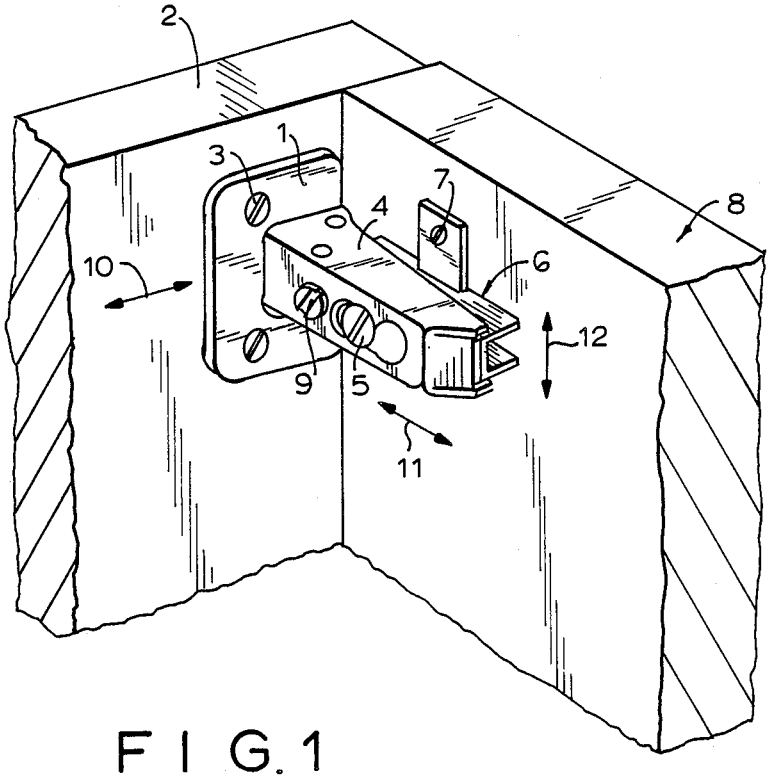
FIG. 1 shows a furniture hinge mounted on a door and a furniture body, the hinge arm of which is mounted on a mounting plate in accordance with the invention.

The furniture hinge illustrated in FIG. 1 is mounted with its housing 1 on a furniture door 2 by means of screws 3. A hinge arm 4 is pivotably mounted on the housing, whereby this hinge arm is mounted by means of a screw 5 on a mounting plate 6 which is mounted on the furniture body 8 by means of screws 7.

A side adjustment can be performed in direction of arrows 10 by releasing the mounting screw 5 and by actuating a set screw 9.

By releasing the mounting screw 5 a lowering adjustment in the longitudinal axis of the hinge arm 4 can be performed in direction of arrows 11. The mounting screw must again be tightened after the adjustment movement. The heightwise adjustment of the hinge is performed in the direction of arrows 12. The mounting plate 6 is designed in two parts for this purpose and consists of an upper part 13 and a base plate 14 which is equipped with throughput bores 15 for mounting screws 7. Furthermore, the base plate 14 is provided with a thread bore 16 into which the thread shaft 17 of a mounting screw 18 is screwed, so as to lock the upper part 13 with respect to base plate 14. The thread shaft 17 is guided through a slotted hole 19 in upper part 13, so that the upper part 13 is adjustable transversely to its longitudinal axis 20 when screw 18 is released.

Figure 2:
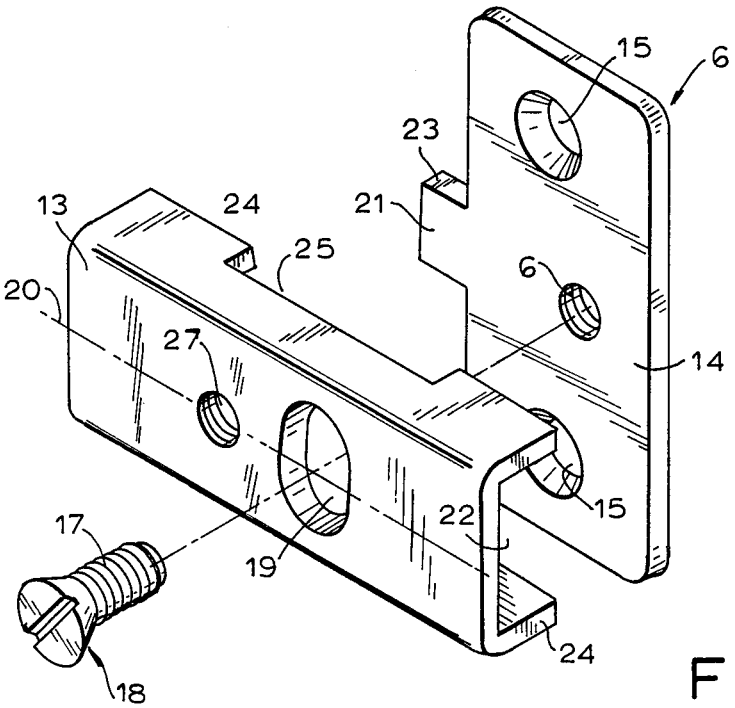
FIG. 2 shows the mounting plate illustrated in FIG. 1 in a perspective view and in a disassembled state.

In the illustrated exemplified embodiment in accordance with FIG. 2, the base plate 14 is provided with an abutment plate 21 which engages into the inner chamber 22 of the upper part and whose the front faces 23 of which limit the adjustment path of the upper part with respect to base plate 14. The width of base plate 21 is thereby smaller by the maximum adjustment stroke than the width of the inner chamber 22 between the inner faces of the side plates 24 of the upper part 13.

The side plates of the upper part are provided with rectangular shaped recesses 25 and the base plate 14 engages into these recesses. The height of the recesses 25 corresponds to the thickness of the base plate 14. This can also be seen in FIG. 3.

Figure 3:
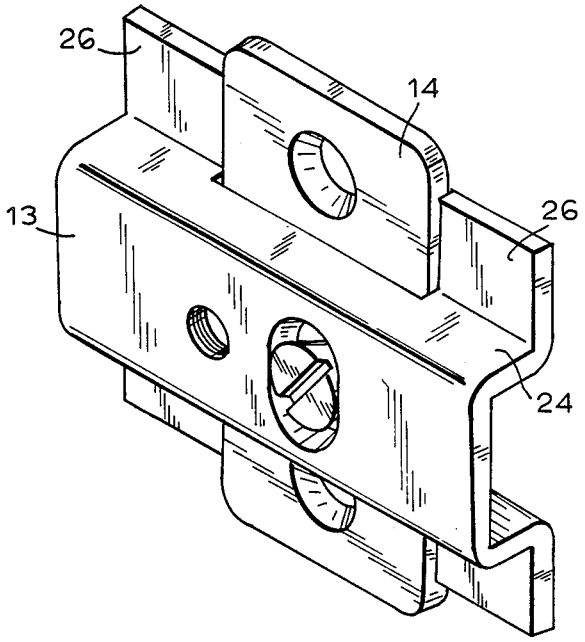
FIG. 3 is a perspective illustration of a modified shape of the mounting plate in accordance with FIG. 2.

In the exemplified embodiment of FIG. 3, each side plate 24 of the upper part is provided with deflected cover plates 26 which are disposed at both sides of the recesses 25. With these cover plates the locking between the upper plate 13 and the base plate 14 is more intensified.

From FIGS. 2 and 3 it can be seen that the base plate as well as the upper part may be shaped as stamped sheet metal parts.

After locking the upper part 13 on base plate 14 by tightening the mounting screw 18, the head of this mounting screw supports on the edge of the slotted hole 19.

The upper part is equipped with a thread bore 27 in which the thread shaft of the mounting screw 5 of the hinge arm 4 is locked.

I claim:

1. Mounting plate for a furniture hinge which is adjustable in height and has a hinge arm mountable on the mounting plate, the plate comprising an upper part (13) and a base plate (14) which is mountable on a furniture body, the base plate (14) engaging in a center area thereof in recesses (25) of the upper part and extending transversely to a longitudinal axis (20) thereof and being displaceably and lockably mounted therein, said base plate being formed with an abutment plate (21) which has front faces (23), said upper plate having an inner chamber, said abutment plate being received in said inner chamber, said front faces limiting an adjustment path of the upper part with respect to the base plate.

2. Mounting plate in accordance with claim 1, characterized in that the upper part (13) is provided with a U-shaped cross section and that the upper part and the base plate (14) are designed as stamped sheet metal parts.

3. Mounting plate in accordance with claim 1, characterized in that recesses (25) are provided in side plates (24) of the upper part and are rectangularly shaped.

4. Mounting plate for a furniture hinge which is adjustable in height and has a hinge arm mountable on the mounting plate, the plate comprising an upper part (13) having an inner chamber and a base plate (14) whih is mountable on a furniture body, the base plate (14) engaging in a center area thereof in recesses (25) of the upper part and extending transversely to a longitudinal axis (20) thereof and being displaceably and lockably mounted therein, said upper part (13) being provided with a U-shaped cross section, and the upper part and the base plate (14) being formed as stamped sheet metal parts, said upper plate having side plates provided with said recesses (25), said recesses being rectangularly shaped, said base plate (14) being provided with an abutment plate (21) disposed in the inner chamber (22) of the upper part (13), said plate having front faces (23) which limit an adjustment path of the upper part with respect to the base plate.

5. Mounting plate for a furniture hinge which is adjustable in height and has a hinge arm mountable on the mounting plate, the plate comprising, an upper part (13) and a base plate (14) which is mountable on a furniture body, the base plate (14) engaging in a center area thereof in recesses (25) of the upper part and extending transversely to a longitudinal axis (20) thereof and being displaceable and lockably mounted therein, said upper part (13) being provided with a U-shaped cross section, and the upper part and the base plate (14) being formed as stamped sheet metal parts, said upper plate having side plates provided with said recesses (25), said recesses being rectangularly shaped, each side plate (24) being provided with deflected cover plates (26) disposed at both sides of the recesses (25).

6. Mounting plate for a furniture hinge which is adjustable in height and has a hinge arm mountable on the mounting plate, the plate comprising, an upper part (13) and a base plate (14) which is mountable on a furniture body, the base plate (14) engaging in a center area thereof in a recess (25) formed in the upper part and extending transversely to a longitudinal axis (20) thereof and being displaceably and lockably mounted therein, said upper part (13) being provided with a slotted hole (19) determines an adjustment stroke of the upper part with respect to the base plate (14), said base plate having a threaded bore (16); and a mounting screw (18) having a head and a threaded shaft (17), whereby the head of the mounting screw (18) supports on an edge of the slotted hole and engages with said threaded shaft (17) into the threaded bore (16) of the base plate, the upper part having a U-shaped cross-section, and the upper and the base plate being formed as stamped sheet metal parts, the base plate being formed with an abutment plate (21) which has front faces (23), said upper plate having an inner chamber, said abutment plate being received in said inner chamber, said front faces limiting an adjustment path of the upper part with respect to the base plate.

* * * * *